US006427339B1

(12) United States Patent
Andrew

(10) Patent No.: US 6,427,339 B1
(45) Date of Patent: Aug. 6, 2002

(54) ELECTRICAL METAL CUTTING DEVICE

(76) Inventor: George Andrew, 307 E. 59th St., Brooklyn, NY (US) 11203

( * ) Notice: Subject to any disclaimer, the term of this patent is extended or adjusted under 35 U.S.C. 154(b) by 112 days.

(21) Appl. No.: 09/591,128

(22) Filed: Jun. 10, 2000

(51) Int. Cl.[7] ..... B26B 7/00
(52) U.S. Cl. ..... 30/277.4; 30/272.1; 30/286
(58) Field of Search ..... 30/151, 272.1, 30/277.4, 275.4, 286, 295, 392

(56) References Cited

U.S. PATENT DOCUMENTS

| | | | | | |
|---|---|---|---|---|---|
| 1,896,580 | A | * | 2/1933 | Gilmore | 30/151 |
| 2,367,945 | A | * | 1/1945 | Jorgensen | 30/286 |
| 3,642,002 | A | * | 2/1972 | Otterstrom | 30/272.1 |
| 3,832,772 | A | * | 9/1974 | Sumida | 30/392 |
| 4,105,080 | A | | 8/1978 | Gunning | 173/66 |
| 4,164,813 | A | | 8/1979 | Dittert | 30/272 |
| 4,300,287 | A | | 11/1981 | Tibbs | 30/289 |
| 4,711,030 | A | * | 12/1987 | Ruston, Sr. | 30/272.1 |
| 6,006,435 | A | * | 12/1999 | Chien | 30/392 |

* cited by examiner

*Primary Examiner*—Hwei-Slu Payer
(74) *Attorney, Agent, or Firm*—Goldstein & Lavas, P.C.

(57) ABSTRACT

An electrical metal cutting device including a housing having a generally L-shaped configuration. The housing has a hollow interior. The housing has a horizontally disposed upper portion and a vertically disposed lower portion. The upper portion has an open outer end. A motor is disposed within the upper portion of the housing. The motor is couplable with an outside power source. A power cylindrical bore is disposed within the upper portion of the housing inwardly of the open outer end thereof. The power cylindrical bore has a shaft extending inwardly therefrom. The shaft has a free end coupling with the motor. The power cylindrical bore has an open outer end. A power piston is slidably positioned within the open outer end of the power cylindrical bore. The power piston has an outer end extending outwardly of the open outer end of the upper portion of the housing. The power piston has an opening in its outer end. A cutting blade is secured within the opening in the outer end of the power piston.

6 Claims, 2 Drawing Sheets

ELECTRICAL METAL CUTTING DEVICE

BACKGROUND OF THE INVENTION

The present invention relates to an electrical metal cutting device and more particularly pertains to allowing metal objects to be cut in difficult to reach areas.

The use of tools and accessories is known in the prior art. More specifically, tools and accessories heretofore devised and utilized for the purpose of cutting objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,105,080 to Gunning discloses an air hammer capable of reciprocation when connected to a source of pressurized air. U.S. Pat. No. 4,300,287 to Tibbs discloses a tool attachable to an air hammer for removing the skin of an automobile. U.S. Pat. No. 4,164,813 to Dittert discloses an electrically powered knife.

While these devices fulfill their respective, particular objective and requirements, the aforementioned patents do not describe an electrical metal cutting device for allowing metal objects to be cut in difficult to reach areas.

In this respect, the electrical metal cutting device according to the present invention substantially departs from the conventional concepts and designs of the prior art, and in doing so provides an apparatus primarily developed for the purpose of allowing metal objects to be cut in difficult to reach areas.

Therefore, it can be appreciated that there exists a continuing need for a new and improved electrical metal cutting device which can be used for allowing metal objects to be cut in difficult to reach areas. In this regard, the present invention substantially fulfills this need.

SUMMARY OF THE INVENTION

In the view of the foregoing disadvantages inherent in the known types of tools and accessories now present in the prior art, the present invention provides an improved electrical metal cutting device. As such, the general purpose of the present invention, which will be described subsequently in greater detail, is to provide a new and improved electrical metal cutting device which has all the advantages of the prior art and none of the disadvantages.

To attain this, the present invention essentially comprises a housing having a generally L-shaped configuration.

The housing has a hollow interior. The housing has a horizontally disposed upper portion and a vertically disposed lower portion. The upper portion has an open outer end. A motor is disposed within the upper portion of the housing. The motor has a corresponding activation trigger disposed within the lower portion of the housing. The activation trigger has an outer portion disposed outwardly of the lower portion of the housing. The motor is couplable with an outside power source. A power cylindrical bore is disposed within the upper portion of the housing inwardly of the open outer end thereof. The power cylindrical bore has a shaft extending inwardly therefrom. The shaft has a free end coupling with the motor. The power cylindrical bore has an open outer end. A power piston is slidably positioned within the open outer end of the power cylindrical bore. The power piston has an outer end extending outwardly of the open outer end of the upper portion of the housing. The power piston has an opening in its outer end. A cutting blade is secured within the opening in the outer end of the power piston. A compression spring is secured to the outer end of the power piston. The compression spring has a ring guard receiving the cutting blade therethrough. The compression spring has a hooked portion extending downwardly therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electrical metal cutting device which has all the advantages of the prior art tools and accessories and none of the disadvantages.

It is another object of the present invention to provide a new and improved electrical metal cutting device which may be easily and efficiently manufactured and marketed.

It is a further object of the present invention to provide a new and improved electrical metal cutting device which is of durable and reliable construction.

An even further object of the present invention is to provide a new and improved electrical metal cutting device which is susceptible of a low cost of manufacture with regard to both materials and labor, and which accordingly is then susceptible of low prices of sale to the consuming public, thereby making such an electrical metal cutting device economically available to the buying public.

Even still another object of the present invention is to provide a new and improved electrical metal cutting device for allowing metal objects to be cut in difficult to reach areas.

Lastly, it is an object of the present invention to provide a new and improved electrical metal cutting device including a housing having a generally L-shaped configuration. The housing has a hollow interior. The housing has a horizontally disposed upper portion and a vertically disposed lower portion. The upper portion has an open outer end. A motor is disposed within the upper portion of the housing. The motor is couplable with an outside power source. A power cylindrical bore is disposed within the upper portion of the housing inwardly of the open outer end thereof. The power cylindrical bore has a shaft extending inwardly therefrom. The shaft has a free end coupling with the motor. The power cylindrical bore has an open outer end. A power piston is slidably positioned within the open outer end of the power cylindrical bore. The power piston has an outer end extending outwardly of the open outer end of the upper portion of the housing. The power piston has an opening in its outer end. A cutting blade is secured within the opening in the outer end of the power piston.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
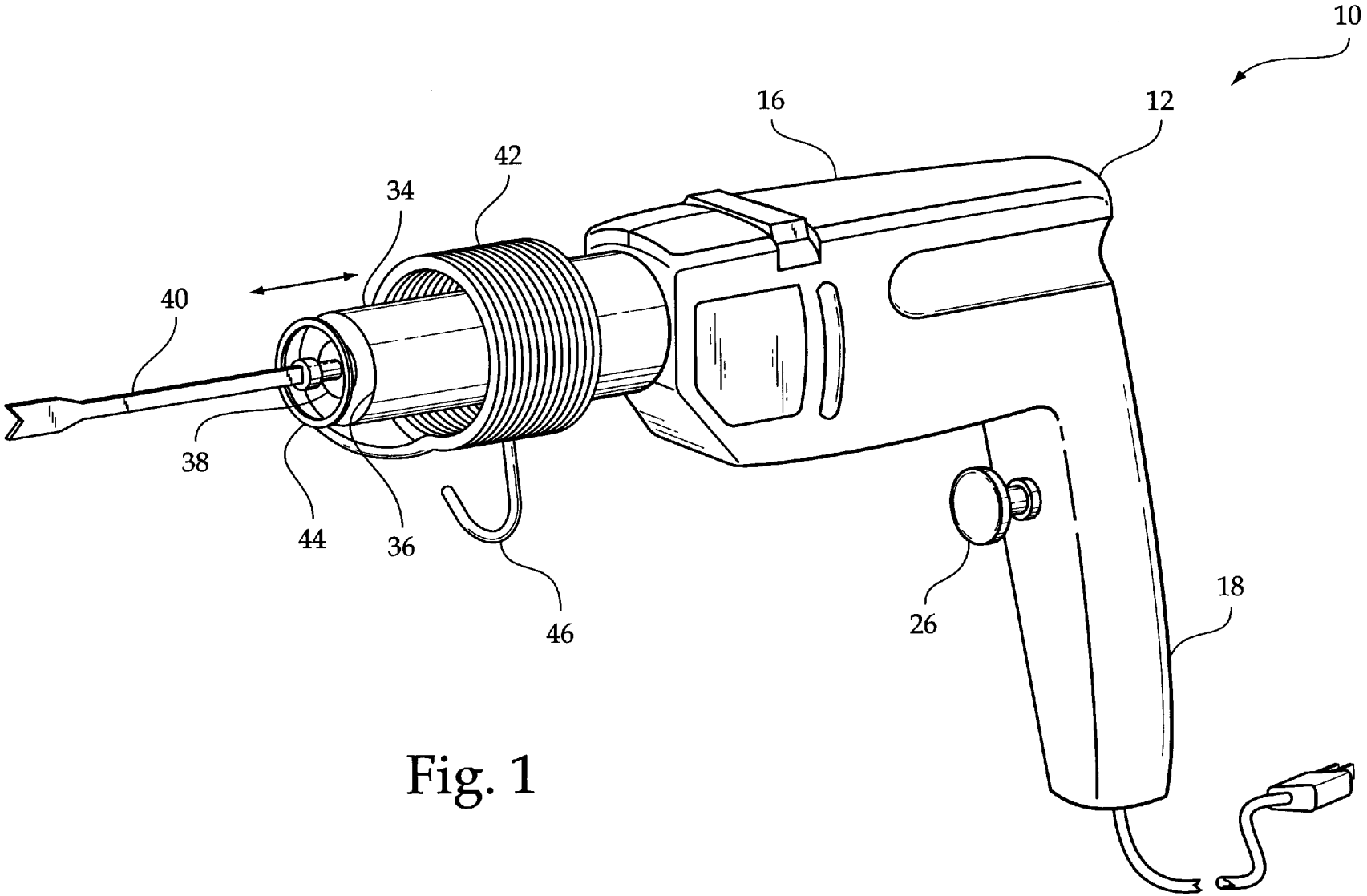
FIG. 1 is a perspective view of the preferred embodiment of the electrical cutting device constructed in accordance with the principles of the present invention.
Figure 2:
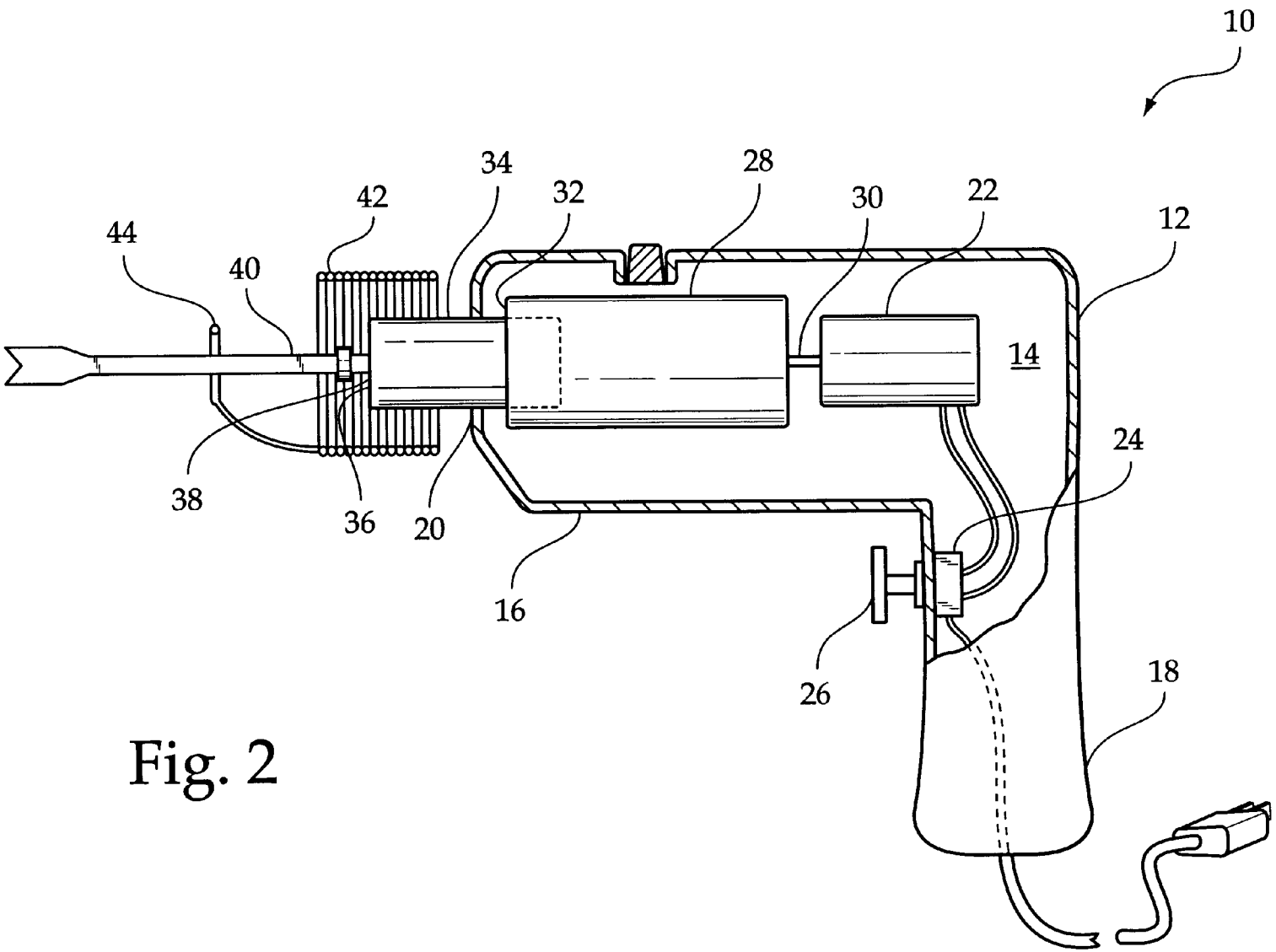
FIG. 2 is a cross-sectional side view of the present invention.

With reference now to the drawings, and in particular, to FIGS. 1 and 2 thereof, the preferred embodiment of the new and improved electrical metal cutting device embodying the principles and concepts of the present invention and generally designated by the reference number 10 will be described.

Specifically, it will be noted in the various figures that the device relates to an electrical metal cutting device for allowing metal objects to be cut in difficult to reach areas. In its broadest context, the device consists of a housing, a motor, a power cylindrical bore, a power piston, a cutting blade, and a compression spring. Such components are individually configured and correlated with respect to each other so as to attain the desired objective.

The housing 12 has a generally L-shaped configuration. The housing 12 has a hollow interior 14. The housing 12 has a horizontally disposed upper portion 16 and a vertically disposed lower portion 18. The upper portion 16 has an open outer end 20.

The motor 22 is disposed within the upper portion 16 of the housing 12. The motor 22 has a corresponding activation trigger 24 disposed within the lower portion 18 of the housing 12. The activation trigger 24 has an outer portion 26 disposed outwardly of the lower portion 18 of the housing 12. The motor 22 is couplable with an outside power source, such as an electrical outlet so as to provide power to the motor 22.

The power cylindrical bore 28 is disposed within the upper portion 16 of the housing 12 inwardly of the open outer end 20 thereof. The power cylindrical bore 28 has a shaft 30 extending inwardly therefrom. The shaft 30 has a free end coupling with the motor 22. The power cylindrical bore 28 has an open outer end 32.

The power piston 34 is slidably positioned within the open outer end 32 of the power cylindrical bore 28. The power piston 34 has an outer end 36 extending outwardly of the open outer end 20 of the upper portion 16 of the housing 12. The power piston 34 has an opening 38 in its outer end 36.

The cutting blade 40 is secured within the opening 38 in the outer end 36 of the power piston 34. The cutting blade 40 is preferably elongated with cutting teeth formed along its lower edge with a sharpened free end.

The compression spring 42 is secured to the outer end 36 of the power piston 34. The compression spring 42 has a ring guard 44 receiving the cutting blade 40 therethrough. The compression spring 42 has a hooked portion 46 extending downwardly therefrom.

In use, the pressing of the activation trigger will activate the motor 22. The motor 22 will rotate the shaft 30 of the power cylindrical bore 28 which, in turn, will cause the power piston to reciprocate thereby causing the cutting blade 40 to reciprocate. The compression spring 42 will expand and contract with the in and out movements of the piston 34. The ring guard 44 will serve to prevent the user from accidentally being cut.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, In falling within the scope of the invention.

What is claimed as being new and desired to be protected by LETTERS PATENT of the United States is as follows:

1. An electrical metal cutting device for allowing metal objects to be cut in difficult to reach areas comprising, in combination:

a housing having a generally L-shaped configuration, the housing having a hollow interior, the housing having a horizontally disposed upper portion and a vertically disposed lower portion, the upper portion having an open outer end;

a motor disposed within the upper portion of the housing, the motor having a corresponding activation trigger disposed within the lower portion of the housing, the activation trigger having an outer portion disposed outwardly of the lower portion of the housing, the motor being couplable with an outside power source;

a power cylindrical bore disposed within the upper portion of the housing inwardly of the open outer end thereof, the power cylindrical bore having a shaft extending inwardly therefrom, the shaft having a free end coupling with the motor, the power cylindrical bore having an open outer end;

a power piston slidably positioned within the open outer end of the power cylindrical bore, the power piston having an outer end extending outwardly of the open outer end of the upper portion of the housing, the power piston having an opening in its outer end;

a cutting blade secured within the opening in the outer end of the power piston; and a compression spring secured to the outer end of the power piston, the compression spring having a ring guard receiving the cutting blade therethrough, the compression spring having a hooked portion extending downwardly therefrom.

2. An electrical metal cutting device for allowing metal objects to be cut in difficult to reach areas comprising, in go combination:

a housing having a generally L-shaped configuration, the housing having a hollow interior, the housing having a horizontally disposed upper portion and a vertically disposed lower portion, the upper portion having an open outer end;

a motor disposed within the upper portion of the housing, the motor being couplable with an outside power source;

a power cylindrical bore disposed within the upper portion of the housing inwardly of the open outer end thereof, the power cylindrical bore having a shaft extending inwardly therefrom, the shaft having a free end coupling with the motor, the power cylindrical bore having an open outer end;

a power piston slidably positioned within the open outer end of the power cylindrical bore, the power piston having an outer end extending outwardly of the open outer end of the upper portion of the housing, the power piston having an opening in its outer end; and a cutting blade secured within the opening in the outer end of the power piston.

3. The electrical metal cutting device as set forth in claim 2, wherein the motor has a corresponding activation trigger disposed within the lower portion of the housing, the activation trigger having an outer portion disposed outwardly of the lower portion of the housing.

4. The electrical metal cutting device as set forth in claim 2 and further including a compression spring secured to the outer end of the power piston.

5. The electrical metal cutting device as set forth in claim 4, wherein the compression spring has a ring guard receiving the cutting blade therethrough.

6. The electrical metal cutting device as set forth in claim 4, wherein the compression spring has a hooked portion extending downwardly therefrom.

* * * * *